US009255679B2

(12) United States Patent
Roebke

(10) Patent No.: US 9,255,679 B2
(45) Date of Patent: Feb. 9, 2016

(54) LED READING LIGHT AND METHOD OF REPLACING AN LED READING LIGHT

(71) Applicant: Goodrich Lighting Systems GmbH, Lippstadt (DE)

(72) Inventor: Steffen Roebke, Paderborn (DE)

(73) Assignee: GOODRICH LIGHTING SYSTEMS GMBH (DE)

( * ) Notice: Subject to any disclaimer, the term of this patent is extended or adjusted under 35 U.S.C. 154(b) by 0 days.

(21) Appl. No.: 14/212,335

(22) Filed: Mar. 14, 2014

(65) Prior Publication Data

US 2014/0254190 A1 Sep. 11, 2014

(30) Foreign Application Priority Data

Mar. 5, 2013 (EP) ..... 13157852

(51) Int. Cl.
*H05B 37/02* (2006.01)
*F21S 8/10* (2006.01)
*H05B 33/08* (2006.01)

(52) U.S. Cl.
CPC ..... *F21S 48/00* (2013.01); *H05B 33/0806* (2013.01); *H05B 33/0824* (2013.01)

(58) Field of Classification Search
USPC ..... 315/185 R, 185 S, 186–193
See application file for complete search history.

(56) References Cited

U.S. PATENT DOCUMENTS

| | | | | |
|---|---|---|---|---|
| 2005/0110426 | A1* | 5/2005 | Shao | 315/185 R |
| 2005/0253533 | A1 | 11/2005 | Lys et al. | |
| 2008/0130288 | A1 | 6/2008 | Catalano et al. | |
| 2010/0039046 | A1* | 2/2010 | Roebke | 315/291 |
| 2010/0123399 | A1* | 5/2010 | Bollmann et al. | 315/122 |
| 2013/0207558 | A1* | 8/2013 | Xu et al. | 315/188 |

OTHER PUBLICATIONS

European Search Report for Application No. 13157852.8-1802 5 Pages.

* cited by examiner

*Primary Examiner* — Douglas W Owens
*Assistant Examiner* — Jonathan Cooper
(74) *Attorney, Agent, or Firm* — Cantor Colburn LLP

(57) ABSTRACT

An LED reading light, in particular for a passenger transport vehicle, such as an aircraft, a road vehicle, a ship or a rail car, is disclosed that has a plurality of illuminating LED's and in operation provides a desired light intensity for a set supply current, wherein the LED reading light comprises two power supply terminals connectable to a power supply for receiving the set supply current, and at least one lighting strand coupled between the two power supply terminals. Each of the at least one lighting strand comprises at least one voltage drop diode, with the at least one voltage drop diode in operation not contributing to the desired light intensity, and at least one of the illuminating LED's. The illuminating LED's are distributed among the at least one lighting strand and connected such that they jointly provide the desired light intensity for the set supply current.

20 Claims, 3 Drawing Sheets

LED READING LIGHT AND METHOD OF REPLACING AN LED READING LIGHT

CROSS REFERENCE TO RELATED APPLICATIONS

This application claims priority to European Patent Application No. 13 157 852.8 filed Mar. 5, 2013, the entire contents of which is incorporated herein by reference.

BACKGROUND

The invention relates to interior lighting systems for passenger transport vehicles, such as aircraft, road vehicles, ships or rail cars. In particular, it relates to an LED reading light for such passenger transport vehicles.

In some passenger transport vehicles, such as air planes, LED reading lights have started to become common place and have started to replace conventional halogen lights. These LED reading lights are exemplarily used as seat lights or reading lights or other interior lights in the passenger cabin. Many passenger transport vehicles have very long life cycles, at least as compared to the life cycles of LED reading lights. Also, changes to the standardisation of components for such passenger transport vehicles, such as changes to the standardized power supply system throughout the passenger cabin in an air plane, tend to be lengthy and cumbersome processes. Much of the technology used in passenger transport vehicles is frozen for long periods of time. This is both due to the keeping of the remaining components in a passenger transport vehicle when replacing certain components and due to industry standards that are constant for long times.

Accordingly, it would be beneficial to provide an LED reading light having improved cost efficiency and being able to be used in passenger transport vehicles without changing their power supply systems. Further, it would be beneficial to provide a method of replacing existing LED reading lights, for example when they are used for a long time or broken, with more cost efficient LED reading lights, while keeping the wiring of the power supply systems.

SUMMARY

Exemplary embodiments of the invention include an LED reading light, in particular for a passenger transport vehicle, such as an aircraft, a road vehicle, a ship or a rail car, the LED reading light having a plurality of illuminating LED's and in operation providing a desired light intensity for a set supply current, the LED reading light comprising two power supply terminals connectable to a power supply for receiving the set supply current, and at least one lighting strand coupled between the two power supply terminals. Each of the at least one lighting strand comprises at least one voltage drop diode, which in operation does not contribute to the desired light intensity, and at least one of the illuminating LED's. The illuminating LED's are distributed among the at least one lighting strand and connected such that they jointly provide the desired light intensity for the set supply current.

In operation, the LED reading light is connected to the power supply, which supplies the set supply current in nominal operation. In some embodiments, the power supply may be a single power source. It can also be an extended power supply system, such as is present for example in an aircraft. In that case, the LED reading light may be coupled to the power supply system directly or via a suitable power adapter unit.

Besides the desired light intensity, the power supply system may expect a certain electric behavior from the LED reading light. In some application examples, the power supply system may expect a certain voltage drop or a certain voltage drop range from the LED reading light unit for the set supply current, especially due to a coding resistor connected in parallel. In other embodiments, the power supply system may expect certain system behaviour of the LED reading light unit in a test operation. In further embodiments, the power supply system may expect certain light intensity changes for a change in supply current, indicating a dimming operation. Details of such different requirements will be described in greater detail below.

The present invention provides a circuit structure that allows for the production of cheaper LED reading lights, while still allowing for the provision of LED reading lights with expected behavior characteristics. In addition, particular embodiments of the invention may also lead to reduced voltage drops for the set supply current, i.e. to reduced power consumption, and/or improved light intensity/light yield.

The number of illuminating LED's and their connection are chosen in such a way that the desired light intensity is provided in operation. The term desired light intensity commonly refers to a desired range of light intensity. In other words, this term does commonly not refer to an exact value, but refers to a desired range of light intensity.

The one or more voltage drop diodes connected in series with the one or more illuminating LED's (in a given lighting strand) ensure that the LED reading light functions as expected by the power supply system, to which it is connected for example in a plane or other passenger transport vehicle. In general terms, the voltage drop diode(s) are chosen and configured in such a way that the LED reading light satisfies at least one requirement expected by the power supply, which would not be satisfied in the absence of the voltage drop diode(s). In other words, the number and configuration of the voltage drop diode(s) ensure that the LED reading light has a desired system behavior in at least one more way in addition to the desired light intensity. Different dimensions of desired system behavior are pointed out above and are described herein. In yet other words, the provision of voltage drop diode(s) allows for the adaptation to a desired/expected electric behavior of the LED reading light.

In this way, it is ensured that a low number of LED's, which have become cheaper due to the technological development, but are still comparably expensive with respect to other circuit elements, is used, while other cheap circuit elements, such as non-light-emitting diodes are used to condition the behaviour of the LED reading light. Therefore, the LED reading light can work seamlessly with existing power supply systems.

The inventive circuit structure also allows for a greater flexibility in producing LED reading lights. For example, a situation may arise where LED's that are used in previous LED reading lights are not readily available. In this case, the inventive circuit structure allows for the usage of different LED's, while the voltage drop diode(s) ensure compliance of the resulting LED reading light with power supply system requirements.

The term illuminating LED refers to LED's of the reading light that contribute to the provision of the desired light intensity in normal operation. The term normal operation, which is also referred to as nominal operation, refers to a situation where the LED reading light is provided with the set supply current. In contrast to the illuminating LED's, the term voltage drop diode refers to a diode that does not contribute to the desired light intensity. In order to not contribute to the desired light intensity, the voltage drop diode(s) can be non-light-emitting in the first place or can be light-emitting, but shielded in such a way that the emitted light does not leave the LED reading light. In other words, the term voltage drop diode refers to non-light-emitting or shielded light-emitting diodes. Further, the term voltage drop diode indicates that those diodes provide for a voltage drop during nominal operation, i.e. during operation of the LED reading light with the set supply current.

The term lighting strand refers to an electric connection between the two power supply terminals. Each one of the one or more lighting strands comprises at least one voltage drop diode and at least one illuminating LED. It is pointed out that the term lighting strand does not preclude certain portions of said strand to have parallel connections of circuit elements.

According to a further embodiment, each of the at least one lighting strand is configured to have a desired lighting strand voltage drop, when the LED reading light is in operation supplied with the set supply current. Again, the term desired lighting strand voltage drop commonly refers to a desired voltage drop range and not to one exact value.

In this way, the LED reading light conforms to a voltage drop requirement that may be associated with the power supply system providing the set supply current. In a particular embodiment, the number of voltage drop diodes in the respective lighting strand may be chosen in such a way that the lighting strand has the desired lighting strand voltage drop in nominal operation. For example, the voltage drop may be adapted with standard diodes having a forward voltage drop of 0.7V. In this way, the overall voltage drop of the lighting strand can be adapted by the provision of cheap circuit elements, such as standard diodes.

According to a further embodiment, the plurality of illuminating LED's is between 4 and 20 illuminating LED's, in particular between 4 and 8 illuminating LED's. It has been found that a number of illuminating LED's between 4 and 8 illuminating LED's per lighting strand or per LED path (explained below) is a good compromise for achieving the desired light intensity with cost-efficient LED's that also have an acceptable voltage drop. In a further particular embodiment, each lighting strand or each LED path has exactly 6 illuminating LED's. It is apparent that the number of illuminating LED's depends on the application and the kind of LED's used.

According to a further embodiment, each lighting strand consists of a pure series connection, the pure series connection comprising at least one voltage drop diode and at least one of the illuminating LED's. In a particular embodiment, the LED reading light has exactly one lighting strand. Having a pure series connection in exactly one lighting strand ensures that all of the set supply current flows through all illuminating LED's. In this way, the system can be well-adapted to the value of the set supply current in nominal operation, which is standardized in many applications for the given power supply systems.

According to a further embodiment, at least one of the at least one lighting strand comprises a parallel connection of two or more LED paths, with each LED path comprising at least one of the illuminating LED's, in particular more than one of the illuminating LED's, in particular between 4 and 8 illuminating LED's, in particular exactly 6 LED's. In this way, the supply current flowing through the lighting strand is split up between the two or more LED paths. Consequently, the current flowing through the individual illuminating LED's is lowered as compared to above described embodiment with a pure series connection. By splitting up the supply current, other kinds of LED's may be used as the illuminating LED's of the individual LED path. In particular, for the case of two LED paths being present as compared to a pure series connection within the lighting strand and for the number of illuminating LED's per LED path staying constant, each illuminating LED only has to provide half of the light intensity. Diodes with a lower light intensity for a lower supply current may even be more cost-efficient. Also, such diodes may have a longer life expectancy, because they only have to carry half the current therethrough. Also, with the supply current flowing through the individual diodes being reduced, the voltage drop across the individual diodes may also be reduced. In this way, the number of LED paths is another degree of freedom for achieving a desired voltage drop in addition to the desired light intensity for nominal operation.

According to a further embodiment, the lighting circuit has a plurality of lighting strands. In this way, the supply current not only flows through multiple LED paths in one lighting strands, but is entirely split up between two or more lighting strands. Each portion of the supply current flows through its own voltage drop diode(s) and its own illuminating LED's, connected in series. This structure allows for each of lighting strands to be dimensioned for a portion of the supply current only. In this way, cheaper/more basic voltage drop diodes can be employed, such that it is possible to achieve an even lower overall cost. Also, it is possible to make the LED reading light more durable, because the circuit components only have to deal with a portion of the supply current. Moreover, increasing the number of circuit components has the advantage that their tolerances even out in a statistic manner Accordingly, such a structure has a greater chance that the emitted light intensity is closer to a particular target value in a desired light intensity range.

It is pointed out that each of the lighting strands may be configured in an identical way. However, it is also possible that the lighting strands are different. In particular, one or more of the lighting strands can have one LED path only, while one or more other lighting strands can have a plurality of LED paths connected in parallel. Still, it is ensured that the overall light intensity, emitted in nominal operation, is in a desired light intensity range.

According to a further embodiment, the plurality of illuminating LED's is/are equally distributed among the plurality of lighting strands. In this way, symmetry between the lighting strands and equal operation thereof is provided. In a particular embodiment, only one type of lighting strand is employed, such that all lighting strands are completely equal. During production, those lighting strands can be provided in pre-assembled form and be joined together to form the LED reading light.

According to a further embodiment, the at least one voltage drop diode is one of a non-light-emitting diode and a shielded light emitting diode. In other words, there is no limitation as to what kind of diodes is used for the voltage drop diode(s). It is merely ensured that the voltage drop diodes do not contribute to the desired light intensity. As is apparent, non-light-emitting diodes cannot contribute to the light intensity emitted by the LED reading light. However, light emitting diodes may also be used as voltage drop diodes, as long as they are shielded and their emitted light is not part of the overall light intensity emitted by the LED reading light.

According to a further embodiment, each of the at least one lighting strand comprises a plurality of voltage drop diodes connected in series. A series connection of voltage drop diodes allows for an easy topology to achieve a desired voltage drop across the voltage drop diodes. Moreover, the series connection allows for the voltage drop to be provided with a low number of circuit components.

According to a further embodiment, each of the at least one lighting strand comprises at least one double diode unit, with each one of the at least one double diode unit having two of the plurality of voltage drop diodes connected in series. Such double diode units are commonly available circuit elements. Using these elements allows for achieving twice the voltage drop of a conventional diode by employing one circuit element only. In the case where more than one double diode unit is employed, such as two, three, four or more double diode units, it is possible to connect those double diode units in series. Such double diode units may also be referred to as twin diodes. Examples are two diodes in a SMD housing.

According to a further embodiment, one diode of one of the at least one double diode unit is bypassed by a shunt connection. An exemplary shunt connection is a mere wire connection that connects the central point of one double diode unit with one of the two sides of the double diode unit. In other words, one diode of one of the at least one double diode unit is bypassed by a short circuit connection. In this way, double diode units are used, which provide twice the voltage drop as compared to single diodes, but which are readily available individual circuit elements, while the increment value for the voltage drop conditioning is still the voltage drop of one single diode.

According to a further embodiment, the LED reading light comprises a coding device coupled between the two power supply terminals and indicative of the set supply current. According to a particular embodiment, the coding device is coupled between the two power supply terminals. It is coupled in parallel with the at least one lighting strand. According to a further embodiment, the coding device is a coding resistor.

Coding resistors are per se are known in prior art LED reading lights. A coding resistor is commonly provided to indicate to the power supply system which value the set supply current should have. In a particular example, the power supply system is able to set the supply current to one of multiple values, for example to one of four values. The value of the coding resistor indicates which one of the four values is best-suited to the particular LED reading light. In this way, production tolerances of the LED reading lights can be accounted for in the following manner. An LED reading light—without a coding resistor—is tested during production for its light intensity characteristics. It is thus determined which of the four current values leads to a light intensity closest to the desired light intensity. Then, a coding resistor is chosen to be included in the LED reading light, the coding resistor indicating which of the four current values the power supply system should use during normal operation. This one of the four values is then used as the set supply current. Hence, the term set supply current is used. However, it is explicitly pointed out that the set supply current does not have to be set in accordance with above operation. It may also set by an industry standard or by a particular application and may therefore by entirely independent from the coding device.

It is to be noted that not every LED reading light has to comprise a special coding resistor. Often, a large lot of LED reading lights are produced each having alike LEDs and an alike coding resistor. There are also power supplies that are able to distinguish between more than four different coding resistors, for example between seven different coding resistors.

Coding devices are not known in combination with the inventive LED reading lights having voltage drop diode(s) in series with illuminating LED('s). It is pointed out that the structure of the inventive LED reading light does not in any way preclude coding devices, such as coding resistors, to be present.

According to a further embodiment, the number of voltage drop diodes in each of the at least one lighting strand is chosen such that a predetermined test current substantially entirely flows through the coding device in a test operation. In a particular embodiment, the test operation comprises the supply of a predetermined test current by the power supply system. In a particular embodiment, the respective lighting strand is configured to prevent the illuminating LED's in the respective lighting strand from emitting light in the test operation. In that case, the number of voltage drop diodes is chosen in such a way as to prevent the illuminating LED's in the respective lighting strand from emitting light in the test operation. The expression "to prevent the illuminating LED's from emitting light" is understood as not emitting a substantial quantity of light. In other words, this expression corresponds to the expression that no substantial amount of current is passed through the illuminating LED's. In this way, it is ensured that the reading of the value of the coding device works as expected by the power supply.

The LED reading light may be a reading light in the strict sense of the word or an orientation light or a helping light for handling other devices that are at the passenger's disposal.

Typical values for the set supply current may be 60 mA . . . 240 mA. Typical values for the coding resistor may be 10 kOhm . . . 42 kOhm Typical values for the set supply current and for the test current may be 0.4 mA . . . 2 mA.

Exemplary embodiments of the invention further include a passenger transport vehicle, such as an aircraft, a road vehicle, a ship or a rail car, having at least one LED reading light, as described in any of the embodiments above, the at least one LED reading light being positioned in an interior of the passenger transport vehicle. The aircraft may be an air plane or a helicopter. The road vehicle may be a bus, a truck or a car. Above modifications and advantages equally relate to the passenger transport vehicle.

Exemplary embodiments of the invention further include a method of replacing a used LED reading light, in particular in a passenger transport vehicle, such as an aircraft, a road vehicle, a ship or a rail car, with an LED reading light, as described in any of the embodiments above, the method comprising the steps of disconnecting the used LED reading light from a power supply; and connecting the power supply terminals of the LED reading light, as described in any of the embodiments above, to the power supply. In this way, new cost-efficient LED reading lights can be included into existing systems in a seamless manner.

BRIEF DESCRIPTION OF THE DRAWING

Embodiments of the invention are described in greater detail below with reference to the figures, wherein.

DETAILED DESCRIPTION

Figure 1:
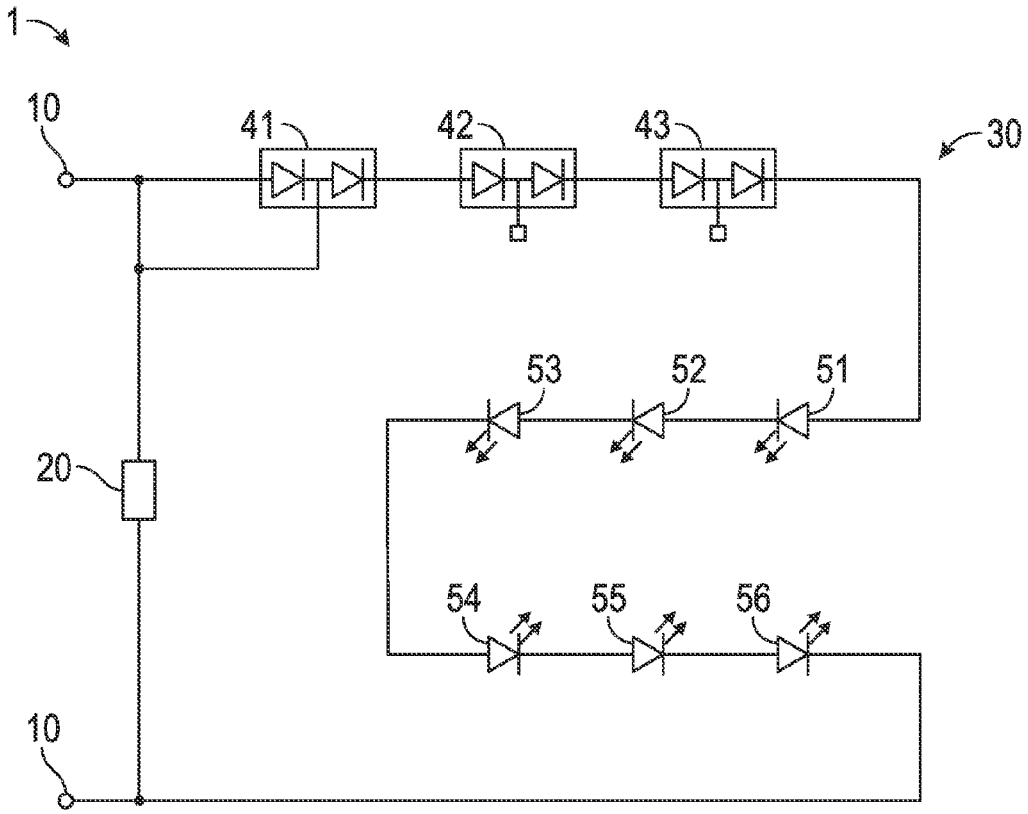
FIG. 1 shows a circuit diagram of a first exemplary embodiment of an LED reading light in accordance with the invention.

FIG. 1 shows a circuit diagram of an LED reading light 1 in accordance with a first exemplary embodiment of the invention. The LED reading light 1 is commonly an encased part, which can be mechanically connected to a fixture, where it connects electrically with a power supply system. Therefore, the LED reading light 1 may also be referred to as an LED reading light unit. The particular design of the case, including the fixture design and the design of the transparent cover, through which light is emitted, is not relevant to the present invention. According details have been left out in the Figures.

The LED reading light 1 has two power supply terminals 10, where it is connectable to a power supply system. In the exemplary embodiment, the LED reading light 1 may be used in the interior of an air plane, which air plane has a power supply system. In many air planes, a standardized power supply adapter is provided per passenger. It is often referred to as Passenger Interface & Supply Adapter (PISA). This PISA is adapted to provide a set supply current to the LED reading light.

The LED reading light 1 has a coding resistor 20 connected between the two power supply terminals 10. Further, the LED reading light has a lighting strand 30 connected between the two power supply terminals 10. The lighting strand 30 is connected in parallel with the coding resistor 20. In the embodiment of FIG. 1, the LED reading light 1 has exactly the one lighting strand 30. No further lighting strands are provided.

The lighting strand 30 comprises three double diode units 41, 42, 43 and six illuminating LED's 51, 52, 53, 54, 55, 56. As their name suggests, the illuminating LED's 51-56 are light emitting diodes. Each of the three double diode units 41, 42, 43 comprises two voltage drop diodes. These voltage drop diodes can be any type of diode that has a forward voltage drop. They are generally "regular" p-n junction diodes. In the present example, they are not LED's, and therefore do not contribute to the overall light emitted by the LED reading light 1. However, it is also possible that the voltage drop diodes of the double diode units 41, 42, 43 are LED's that are shielded by a casing, such that they do not contribute to the emitted light.

The three double diode units 41-43 and the six illuminating LED's 51-56 are connected in series between the two power supply terminals 10. One voltage drop diode of the first double diode unit 41 is bypassed by a connection between the center point of the double diode unit with the high potential terminal of the two power supply terminals 10. In this way, the "effective" series connection between the two power supply terminals, i.e. the current path between the two power supply terminals through the lighting strand 30, comprises 5 voltage drop diodes and the six illuminating diodes 51-56.

It is pointed out that any other voltage drop diode could by bypassed by connecting any center point of any double diode unit to either of the two terminals of that double diode unit. It is apparent that the same electric behavior would result. In this context, it is further pointed out that the series connection of voltage drop diodes and illuminating diodes does not have to be provided in the shown way where the current flows through the voltage drop diodes before flowing through the illuminating LED's. Again, it is apparent that it does not make a difference electrically if the order of the voltage drop diodes and illuminating diodes is reversed or mixed in any way. As long as they are connected in series, the same electric behavior will result.

The operation of the LED reading light 1 will now be described. In particular, two modes of operation will be described, which may both be carried out when the LED reading light 1 is connected to the power supply system (not shown). A first mode of operation is a nominal operation, also referred to as normal operation, where the LED reading light 1 is used as a light source with a desired light intensity. A second mode of operation is a test operation, wherein the value of the coding resistor is read out by the power supply system.

During the normal operation, a set supply current is provided by the power supply system. In the present example, the set supply current is provided by the PISA, as it is commonly found in air planes. An exemplary set supply current, as provided by the PISA, is in the range of 60 mA . . . 240 mA. A common PISA expects the voltage drop of an LED reading light connected thereto to be in the range between 19V and 23V. In that case, the PISA assumes that the LED reading light is functioning properly.

The majority of the set supply current flows through the lighting strand 30. The exemplary illuminating LED's 51-56 have a voltage drop of approximately 3V for the exemplary set supply current. Consequently, the total voltage drop across the six illuminating LED's 51-56 is approximately 18V. The standard diodes, employed as voltage drop diodes in the double diode units 41-43, have a forward voltage drop of approximately 0.7V. With five voltage drop diodes being placed in the current path, the voltage drop across those five voltage drop diodes is approximately 3.5V. Consequently, the overall voltage drop in the lighting strand 30 is approximately 21.5V.

In this way, the voltage drop diodes ensure that the overall voltage drop is above 19V. Therefore, the electric behavior between the two power supply terminals 10 corresponds to what is expected by the PISA. The correspondence with the expected behavior signals to the PISA that the LED reading light 1 functions properly.

It can also be seen that the voltage drop diodes allow for the adaptation of the voltage drop between the two power supply terminals 10 to a desired value. The value of approximately 21.5V is an advantageous value in a number of ways. First, it signals a good working order of the LED reading light 1 to the PISA. Second, it ensures a low power consumption within the expected range. Third, it still provides for a safety margin with respect to the 20V threshold for the case of voltage/current irregularities or measuring tolerances or production tolerances.

During the test operation, the power supply system provides a test current to the LED reading light 1. The test current is small in comparison with the set supply current. In the particular example of a PISA in an air plane, a common value of the test current is in the range of 0.4 mA . . . 2 mA.

The test current flows through the coding resistor 20 and gives rise to a voltage drop across the coding resistor 20. This is what the PISA expects. It measures the voltage across the two power supply terminals 10 and calculates the value of the coding resistor 20 therefrom. On the basis of this value, the PISA selects one of a plurality of supply currents and sets the supply current for normal operation to this value, hence the term "set supply current".

An exemplary value for the coding resistor 20 is in the range of 10 kOhm . . . 42 kOhm. With the test current being in the range of 0.4 mA . . . 2 mA, the voltage drop across the coding resistor in the test operation is below 17V. This is a value where the illuminating LED's 51-56 would start to draw some current and maybe even start to light up in the absence of the voltage drop diodes of the double diode units 41-43. Accordingly, in the absence of the voltage drop diodes, not all of the test current would flow through the coding resistor 20. Since the PISA expects the whole current to flow through the coding resistor 20 and bases its calculation of the value of the coding resistor on this assumption, the PISA would come to an erroneous result.

The voltage drop diodes ensure that no or only a negligible current flows through the lighting strand 30 during the test operation. The voltage drop across the coding resistor, when supplied with the test current, is not big enough to put the voltage drop diodes and the illuminating LED's 51-56 in the lighting strand 30 in the conductive state. Accordingly, the voltage drop diodes also serve the purpose of ensuring a correct measurement of the coding resistor 20 during the test operation.

It is further pointed out that the number of six illuminating LED's is chosen in such a way that their joint light intensity is within the desired light intensity range of the LED reading light 1, when supplied with the set supply current. It is apparent that the number of illuminating LED's may be altered in order to reach a different light intensity, depending on the particular application. Equally, the number of voltage drop diodes in the current path may be altered, depending what voltage drop is required by a particular application during normal operation and/or what voltage drop is present across the coding resistor 20, such that the lighting strand 30 does not draw any or hardly any current during the test operation. The number of voltage drop diodes and/or the associated voltage drop may also be altered for other reasons, such as the dimming behavior of the LED reading light. It is pointed out that the voltage drop for the voltage drop diodes does not have to be 0.7V.

Figure 2:
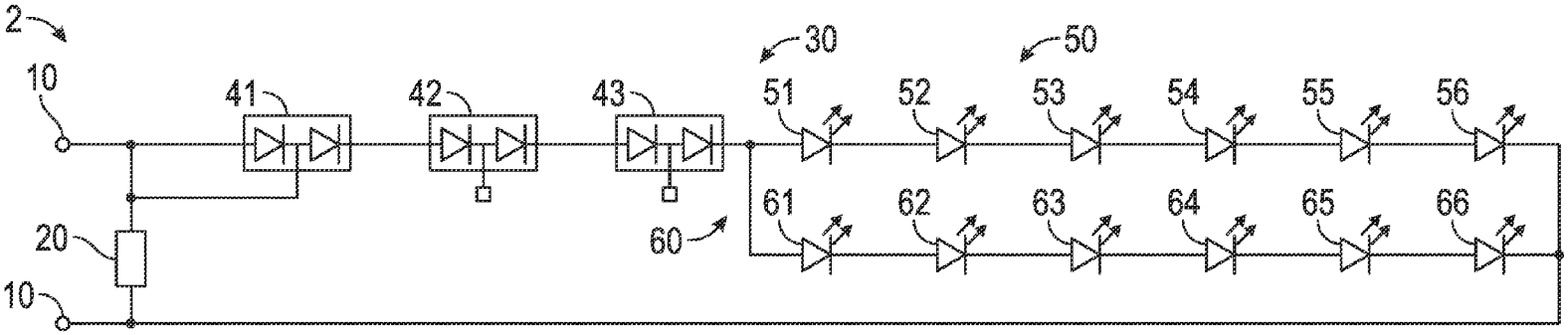
FIG. 2 shows a circuit diagram of a second exemplary embodiment of an LED reading light in accordance with the invention.

FIG. 2 shows a circuit diagram of an LED reading light 2 in accordance with a second exemplary embodiment of the invention. As compared to the exemplary embodiment of FIG. 1, like elements are denoted with like reference numerals. The LED reading light 2 also comprises two power supply terminals 10, a coding resistor 20, and exactly one lighting strand 30.

The lighting strand 30 also comprises three double diode units 41, 42, 43 connected in series, with each of the double diode units 41, 42, 43 comprising two voltage drop diodes and one of the voltage drop diodes being bypassed. The lighting strand 30 of the LED reading light 2 differs from the lighting strand 30 of the LED reading light 1 of FIG. 1 in that it has two LED paths 50 and 60.

Both of the LED paths 50 and 60 of the lighting strand 30 of the LED reading light 2 of FIG. 2 comprise six illuminating LED's. The first LED path 50 comprises six illuminating LED's 51, 52, 53, 54, 55 and 56. The second LED path 60 comprises six illuminating LED's 61, 62, 63, 64, 65 and 66.

In normal operation, the set supply current flows through the double diode units 41, 42, 43 and then splits up between the first LED path 50 and the second LED path 60. All twelve illuminating LED's light up and contribute to the desired light intensity in the normal operation.

As compared to the LED reading light 1 of FIG. 1, the provision of the two LED paths 50 and 60 can have various effects, depending on the set supply current. If the set supply current for the LED reading light 2 is the same as for the LED reading light 1, the current flowing through the individual illuminating LED's is approximately halved (depending on the production tolerances). This might lead to the LED reading light having a higher life expectancy, because the illuminating LED's only have to handle half the current. Also, it might change the light intensity of the LED reading light, depending on the current-light intensity characteristics of the illuminating LED's. If the set supply current is doubled, the provision of two LED paths is an efficient way of providing twice the light intensity as compared to the LED reading light 1 of FIG. 1. In general, the option to provide additional LED path(s) adds another degree of freedom for achieving a desired light intensity and for altering the life expectancy of the LED reading light.

Figure 3:
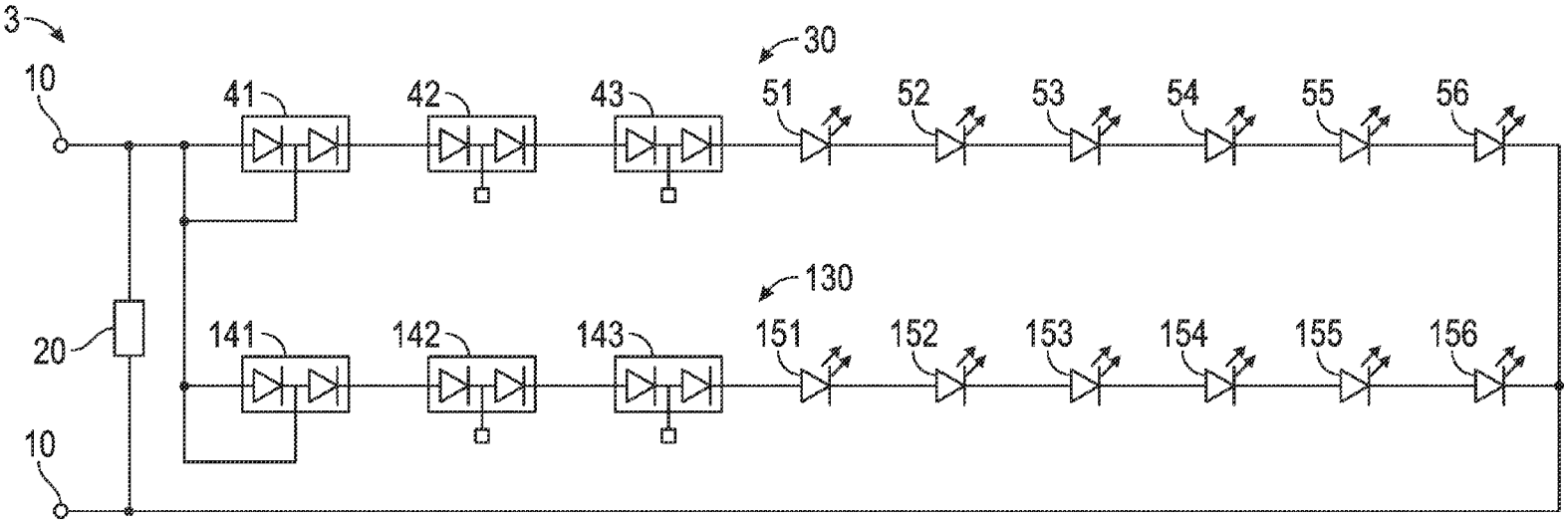
FIG. 3 shows a circuit diagram of a third exemplary embodiment of an LED reading light in accordance with the invention.

FIG. 3 shows a circuit diagram of an LED reading light 3 in accordance with a third exemplary embodiment of the invention. As compared to the exemplary embodiment of FIG. 1, like elements are denoted with like reference numerals. The LED reading light 3 also comprises two power supply terminals 10 and a coding resistor 20. However, the LED reading light 3 comprises a first lighting strand 30 and a second lighting strand 130.

The first lighting strand 30 is connected between the two power supply terminals 10 and exactly corresponds to the single lighting strand 30 of the LED reading light 1 of FIG. 1. Therefore, its elements are denoted with the same reference numerals. The second lighting strand 130 is also connected between the two power supply terminals 10. It is configured in the same way as the first lighting strand 30, hence its reference numerals correspond to the reference numerals of the first lighting strand 30, merely incremented by 100.

In terms of emitted light intensity, the LED reading light 3 of FIG. 3 corresponds to the LED reading light 2 of FIG. 2. The set supply current is split up between two sets of illuminating LED's. Depending on the set supply current, this leads to an altered light intensity and an altered life expectancy, as explained with respect to FIG. 2. While the cost of such a structure seems to be higher at first glance due to the doubling of the number of circuit components, the LED reading light may actually be more cost-efficient, because the individual circuit components may de designed for less current.

The circuit structure of the LED reading light 3 of FIG. 3 differs from the LED reading light 2 of FIG. 2 in that the current is split up between different paths before flowing through the double diode units. In this way, two exactly corresponding lighting strands are formed, with approximately half of the current flowing through each of the two lighting strands 30, 130 (depending on the production tolerances). For the same light intensity as provided by the LED reading light 2 of FIG. 2, the double diode units 41-43 and 141-143 of the LED reading light 3 of FIG. 3 have to carry only half the current as compared to the double diode units 41-43 of the LED reading light 2 of FIG. 2. In this way, those components only have to be designed for half the current, may be cheaper and/or may last longer.

The option to provide separate lighting strands between the two power supply terminals 10 adds another degree of freedom in achieving the desired light intensity in combination with a desired life expectancy at low cost.

It is pointed out that a hybrid embodiment between the LED readings lights 2 and 3 of the FIGS. 2 and 3 is also a possible embodiment. For example, when starting from the embodiment of FIG. 2, the double diode unit 43 may be dispensed with. In order to achieve the same voltage drop, one additional double diode unit could be placed into each of the first LED path 50 and the second LED path 60. It is apparent that it does not affect the electric behavior where in the LED paths 50, 60 the additional double diode units are placed. Such an embodiment would still be considered to have one lighting strand, because there is at least one circuit element that the whole set supply current flows through in normal operation (with the exception of the little portion flowing through the coding resistor 20). In general terms, the expression LED path does not require only illuminating LED's to be present in this path.

Figure 4A:
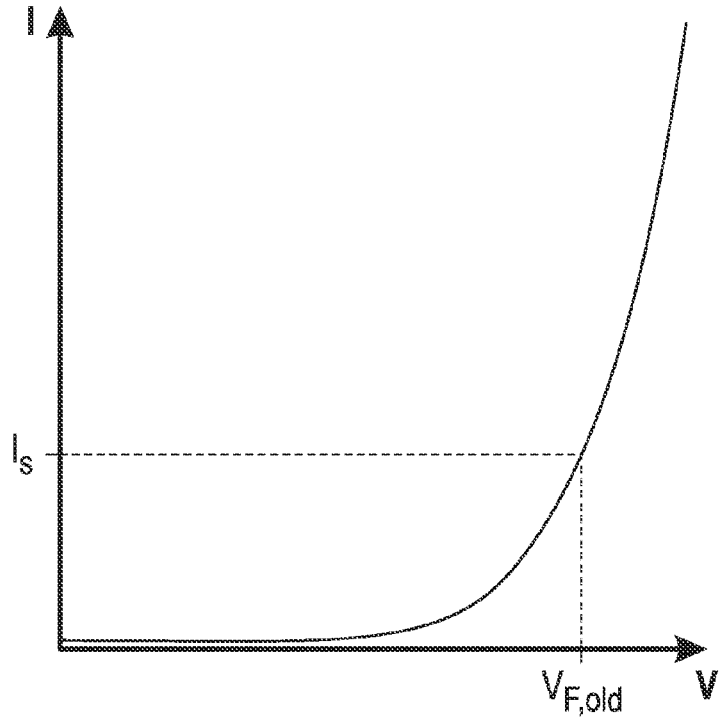
FIGS. 4A-4B show a comparison of the voltage-current-characteristics of an exemplary LED used in previous LED reading lights (FIG. 4A) and an exemplary LED used in exemplary embodiments of the invention (FIG. 4B).
Figure 4B:
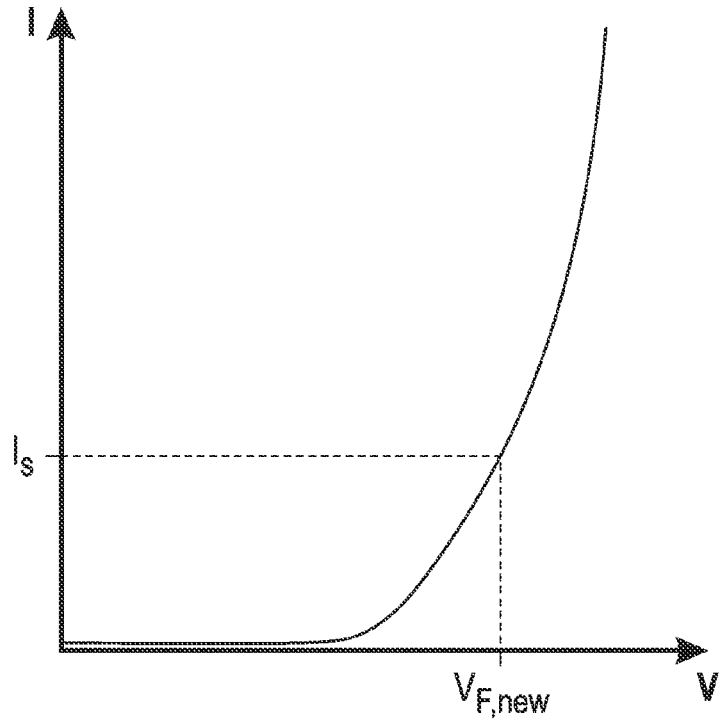

FIG. 4 shows a comparison of the voltage-current-characteristics of an exemplary LED used in previous LED reading lights (FIG. 4A) and an exemplary LED used in exemplary embodiments of the invention (FIG. 4B). This comparison is a good illustration how the present invention achieves cost savings in the framework of set requirements by the power supply systems, which the inventive LED reading lights can be connected to. In the following, an example is described how an "old" LED reading light, employing the "old" LED's of FIG. 4A, is replaced with an exemplary LED reading light in accordance with the invention, also denoted "new" or "improved" LED reading light, employing the "new" LED's of FIG. 4B.

As can be seen from FIG. 4A, the "old" LED, i.e. the exemplary LED used in previous LED reading lights, has a voltage drop VF,old, when the set supply current IS is flown therethrough. In contrast thereto, the "new" LED, i.e. the exemplary LED used in exemplary embodiments of the invention, has a voltage drop VF,new, when the set supply current IS is flown therethrough, as can be seen from FIG. 4B. The voltage drop VF,new is considerably smaller than the voltage drop VF,old. This change in voltage drop is due to the ongoing development in LED technology. In addition to this reduction in voltage drop, recent developments in LED technology also resulted in higher light intensities at the same current level. Therefore, it is assumed that "new" LED's (FIG. 4B) have a lower forward voltage drop and a higher light intensity for a given current than "old" LED's (FIG. 4A) at the same cost. These assumptions are reasonable, given the ongoing development towards smaller voltage drops and higher light yields. Also, this development is ongoing and not at an end, such that this change from "old" to "new" LED's will probably happen constantly over the years to come.

A hypothetical, but reasonable example may be as follows. This example is for illustrative purposes only. Existing LED reading lights may have 8 LED's in accordance with FIG. 4A in series between the two power supply terminals without any other circuit elements. With VF,old being 3.5V, the overall voltage drop in normal operation is 28V. The LED's in accordance with FIG. 4B may have such an increased light intensity that 6 LED's are sufficient for providing the same overall light intensity. With VF,new being 3V, the overall voltage drop across the 6 LED's in normal operation is 18V. As explained above, 5 voltage drop diodes may be placed in the current path to raise the overall voltage drop between the power supply terminals to 21.5V.

In this way, the following effects are achieved. The "new" LED reading light is cheaper, because it comprises only 6 LED's (the 5 voltage drop diodes are very cheap circuit components and are jointly much cheaper than the additional two LED's of the previous LED reading light). The desired light intensity is equally achieved with the "new" LED reading light. The overall voltage drop is reduced, leading to a lower energy consumption by the LED reading light.

Also, the "new" LED reading light still functions as expected in the test operation. Depending on the circuit design, the mere substitution of "old" LED's with "new" LED's may lead to problems during the test operation. As explained above, the test current gives rise a test voltage across the coding resistor. The "old" LED reading lights are designed in such a way that this test voltage is not big enough to put the LED's in a conductive state. The comparison between FIG. 4A and FIG. 4B shows that the improved LED's enter the conductive state at a smaller voltage. Additionally, the improved LED reading lights generally have less LED's in series than the "old" LED reading lights, which makes the LED's even more prone to falling into a conductive state. However, the voltage drop diodes may ensure that the voltage drop between the two power supply terminals necessary for putting the diode series connection into a conductive state is not reached during the test operation.

It is explicitly pointed out that the advantages of reducing cost, of lowering power consumption within a given limit, of achieving a particular desired overall voltage drop between the power supply terminals, and of achieving a non-conductive state of the LED's during the test operation can all be achieved by the provision of the one or more voltage drop diodes. However, it is not required that the one or more voltage drop diodes achieve all of these advantages. Depending on the particular application, the provision of the voltage drop diodes may lead to only one or a subset or all of the above advantages. For example, some applications may not have a coding device, such that the last advantage cannot be attained. Other applications may not require a certain voltage drop range. The important thing is that the voltage drop diode(s) allow for adapting the LED reading light to an expected behavior, no matter what that behavior is.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof Therefore, it is intended that the invention not be limited to the particular embodiment disclosed, but that the invention will include all embodiments falling within the scope of the appended claims.

The invention claimed is:

1. An LED reading light, in particular for a passenger transport vehicle, such as an aircraft, a road vehicle, a ship or a rail car, the LED reading light having a plurality of illuminating LEDs and in operation providing a desired light intensity for a set DC supply current, the LED reading light comprising:

two DC power supply terminals connectable to a power supply for receiving the set DC supply current, and a plurality of lighting strands coupled between the two DC power supply terminals, wherein each of the plurality of lighting strands comprises:

a plurality of voltage drop diodes connected in series, with the plurality of voltage drop diodes in operation not contributing to the desired light intensity, and at least one of the illuminating LEDs connected in series with the plurality of voltage drop diodes, wherein the plurality of lighting strands are coupled in parallel between the two DC power supply terminals, with a current flow through all of the plurality of lighting strands being in the same direction between the two DC power support terminals, wherein each of the at least one light strand is configured to have a desired lighting strand voltage drop, wherein the LED reading light is in operation supplied with the set DC supply current, with a respective number of the plurality of voltage drop diodes of each of the plurality of lighting strands being such that the respective lighting strands has the desired lighting strand voltage drop, when the LED reading light is in operation supplied with the set DC supply, and wherein the illuminating LED are distributed among the plurality of lighting strands and connected such that they jointly provide the desired light intensity for the set DC supply current.

2. An LED reading light according to claim 1, wherein the plurality of illuminating LEDs includes from 4 to 20 illuminating LEDs.

3. An LED reading light according to claim 1, wherein each lighting strand consists of a pure series connection, the pure series connection comprising at least one voltage drop diode and at least one of the illuminating LEDs.

4. An LED reading light according to claim 1, wherein at least one of the plurality of lighting strands comprises a parallel connection of two or more LED paths, with each LED path comprising at least one of the illuminating LEDs.

5. An LED reading light according to claim 1, wherein the plurality of illuminating LEDs are equally distributed among the plurality of lighting strands.

6. An LED reading light according to claim 1, wherein each of the plurality of lighting strands comprises at least one double diode unit, with each one of the at least one double diode unit having two of the plurality of voltage drop diodes connected in series.

7. An LED reading light according to claim 6, wherein one diode of one of the at least one double diode unit is bypassed by a shunt connection.

8. An LED reading light according to claim 1, further comprising a coding device coupled between the two DC power supply terminals and indicative of the set DC supply current.

9. An LED reading light according to claim 8, wherein the coding device is a coding resistor.

10. An LED reading light according to claim 9, wherein the number of voltage drop diodes in each of the plurality of lighting strands is chosen such that substantially all of a predetermined test current flows through the coding device in a test operation.

11. A Passenger transport vehicle, such as an aircraft, a road vehicle, a ship or a rail car, having at least one LED reading light according to claim 1, the at least one LED reading light being positioned in an interior of the passenger transport vehicle.

12. An LED reading light according to claim 1, wherein the plurality of illuminating LEDs includes from 4 to 8 LEDs.

13. An LED reading light of a passenger transport vehicle, such as an aircraft, a road vehicle, a ship, or a rail car, the LED reading light having a plurality of illuminating LEDs and in operation providing a desired light intensity for a set DC supply current, the LED reading light comprising:

two DC power supply terminals connectable to a power supply for receiving the set DC supply current, and at least one lighting strand coupled between the two DC power supply terminals, wherein each of the at least one lighting strand comprises:

a plurality of voltage drop diodes connected in series, with the plurality of voltage drop diodes in operation not contributing to the desired light intensity, and a parallel connection of two or more LED paths, with each LED path comprising at least one of the illuminating LEDs, with the parallel connection of the two or more LED paths being connected in series with the plurality of voltage drop diodes, and with a current flow through the two or more LED paths being in the same direction between the two DC power supply terminals, wherein each of the at least one lighting strand is configured to have a desired lighting strand voltage drop, when the LED reading light is in operation supplied with the set DC supply current, with a respective number of the plurality of voltage drop diodes of each of the at least one lighting strands being such that the respective lighting strand has the desired lighting strand voltage drop, when the LED reading light is in operation supplied with the set DC supply current, and wherein the illuminating LEDs are distributed among the at least one lighting strand and connected such that they jointly provide the desired light intensity for the set DC supply current.

14. The LED reading light according to claim 13, wherein the plurality of illuminating LEDs includes from 4 to 20 illuminating LEDs.

15. The LED reading light according to claim 13, comprising a plurality of lighting strands.

16. The LED reading light according to claim 15, wherein the plurality of illuminating LEDs are equally distributed among the plurality of lighting strands.

17. The LED reading light according to claim 13, wherein each of the at least one lighting strand comprises at least one double diode unit, with each one of the at least one double diode unit having two of the plurality of voltage drop diodes connected in series.

18. The LED reading light according to claim 13, further comprising a coding device coupled between the two DC power supply terminals and indicative of the set DC supply current.

19. A passenger transport vehicle, such as an aircraft, a road vehicle, a ship or a rail car, having at least one LED reading light according to claim 13, the at least one LED reading light being positioned in an interior of the passenger transport vehicle.

20. The LED reading light according to claim 19, wherein the number of voltage drop diodes in each of the at least one lighting strand is chosen such that substantially all of a predetermined test current flows through the coding device in a test operation.

* * * * *